US008689698B2

(12) United States Patent
Shasha et al.

(10) Patent No.: US 8,689,698 B2
(45) Date of Patent: Apr. 8, 2014

(54) METHODS AND SYSTEMS FOR MULTI-DIMENSIONAL MOTION

(76) Inventors: Dennis Shasha, New York, NY (US); Michael John Whittaker, Edmonton (CA)

( * ) Notice: Subject to any disclaimer, the term of this patent is extended or adjusted under 35 U.S.C. 154(b) by 58 days.

(21) Appl. No.: 13/155,448

(22) Filed: Jun. 8, 2011

(65) Prior Publication Data

US 2012/0312186 A1 Dec. 13, 2012

(51) Int. Cl.
*B61B 3/00* (2006.01)

(52) U.S. Cl.
USPC ..... 104/93

(58) Field of Classification Search
USPC ..... 104/63, 64, 81, 82, 53, 56, 57, 74, 75, 104/76, 89, 90; 472/39, 43, 47, 59, 130; 105/35
See application file for complete search history.

(56) References Cited

U.S. PATENT DOCUMENTS 5,081,932 A * 1/1992 Hofmann ..... 104/112
5,558,582 A 9/1996 Swenson et al.
5,623,878 A 4/1997 Baxter et al.
5,759,107 A * 6/1998 Nagel ..... 472/47
6,095,926 A * 8/2000 Hettema et al. ..... 472/59
6,269,749 B1 8/2001 Hogg
6,386,115 B2 5/2002 Mares
6,666,159 B2 * 12/2003 Larson et al. ..... 114/253
6,871,596 B2 * 3/2005 De-Gol ..... 104/53
7,237,492 B2 * 7/2007 Inarida ..... 105/35
7,484,460 B2 * 2/2009 Blum et al. ..... 104/53
7,594,473 B2 * 9/2009 Kitchen et al. ..... 104/53
7,802,522 B2 * 9/2010 Gordon ..... 104/53
7,846,032 B2 * 12/2010 Zamperla et al. ..... 472/34
7,854,202 B2 * 12/2010 Menser et al. ..... 104/127
2006/0213306 A1 9/2006 Hayes et al.
2007/0074638 A1 * 4/2007 Blum et al. ..... 104/53

* cited by examiner

*Primary Examiner* — R. J. McCarry, Jr.
*Assistant Examiner* — Jean Charleston
(74) *Attorney, Agent, or Firm* — Strategic Patents, P.C.

(57) ABSTRACT

An apparatus includes: a fixed primary anchoring element, a beam mount movably connected to the primary anchoring element, a beam connected to the beam mount, a vessel mount movably connected to the beam, a vessel connected to the vessel mount, the vessel being movable along at least a vertical axis, and a control unit within the vessel. The control unit is configured to accept control input from a passenger within the vessel and transmit at least one control signal to cause the beam to move relative to the primary anchoring element, the vessel mount to move relative to the beam, and the vessel to move relative to the vessel mount independently.

25 Claims, 9 Drawing Sheets

METHODS AND SYSTEMS FOR MULTI-DIMENSIONAL MOTION

TECHNICAL FIELD

This disclosure relates to methods and systems for multi-dimensional motion. More specifically, this disclosure relates to methods and systems for three-dimensional motion and six degrees of freedom (up/down, side to side, backwards and forwards, pitch, roll, and yaw), as would be used in flight simulators, amusement rides, construction equipment and the like.

BACKGROUND

It is often desirable to enable a passenger (e.g., a person) to travel within a volume of three-dimensional space. For example, many people enjoy simulated flight. Similarly, it is often useful to train people to pilot vessels (e.g., aircrafts) using a simulator.

SUMMARY

In general, in one aspect, an apparatus includes: a fixed primary anchoring element, a beam mount movably connected to the primary anchoring element, a beam connected to the beam mount, a vessel mount movably connected to the beam, a vessel connected to the vessel mount, the vessel being movable along at least a vertical axis, and a control unit within the vessel. The control unit is configured to accept control input from a passenger within the vessel and transmit at least one control signal to cause the beam to move relative to the primary anchoring element, the vessel mount to move relative to the beam, and the vessel to move relative to the vessel mount independently.

In general, in another aspect, an apparatus includes: a frame comprising a first support and a second support; steerable wheels mounted to the frame, a beam mounted to the first support and the second support, a vessel mount movably connected to the beam, a vessel connected to the vessel mount, the vessel being movable at least along a vertical axis, and a passenger control unit within the vessel configured to accept input and transmit a control signal to cause the frame, beam, vessel mount, and vessel to move independently.

In general, in another aspect, an apparatus includes: a fixed primary anchoring element, a beam mount movably connected to the primary anchoring element, a beam connected to the beam mount, a vessel mount movably connected to the beam, the vessel mount including an axle, a vessel boom rotatably connected to the axle, a vessel connected to the vessel boom, and a control unit configured to transmit at least one control signal to cause the beam, the vessel mount, and the vessel boom to move independently.

Implementations may include one or more of the following features: The primary anchoring element includes a first post, and the beam mount is configured to rotate around the post. The apparatus also includes a beam connected to the beam mount, in which the beam mount includes a support member. The apparatus also includes a second nested post within the first post and a second beam mount rotatably connected to the second post. The primary anchoring element includes a first track, wherein the beam mount is configured to move along the first track. The first track comprises a closed loop. The apparatus also includes a second track approximately parallel to the first track. The apparatus also includes a second beam mount movably connected to the first track. The apparatus also includes a second beam connected to the second beam mount, wherein the second beam is cantilevered with respect to the first track. The apparatus also includes a third track. The apparatus also includes an energy recapture system for braking. The energy recapture system includes a flywheel. The apparatus also includes a counterweight configured to at least partially offset the weight of the vessel. The apparatus also includes a torsion element configured to at least partially offset the weight of the vessel. The beam is extensible along an axis. The apparatus also includes obstacles in an accessible volume of the vessel. The apparatus also includes a weapon mounted on the vessel. The apparatus also includes a yaw plate coupled to the vessel operable to change the vessel's yaw. The apparatus also includes a mechanism to control pitch. The apparatus also includes a mechanism to control roll. The apparatus also includes a gyroscope coupled to the vessel. The vessel mount includes a hydraulic system operable to move the vessel. The hydraulic system includes a counterbalance. The hydraulic system includes a first hydraulic arm rotatably connected to the vessel mount, and a second hydraulic arm rotatably connected to the first hydraulic arm, wherein the vessel is mounted to the second hydraulic arm.

Other aspects include other combinations of the features recited above and other features, expressed as methods, apparatus, systems, program products, and in other ways. Other features and advantages will be apparent from the description and from the claims.

DESCRIPTION OF DRAWINGS

Embodiments of the invention described herein may be understood by reference to the following figures, which are provided by way of example and not of limitation.

Like references numbers refer to like structures.

DETAILED DESCRIPTION

Figure 1:
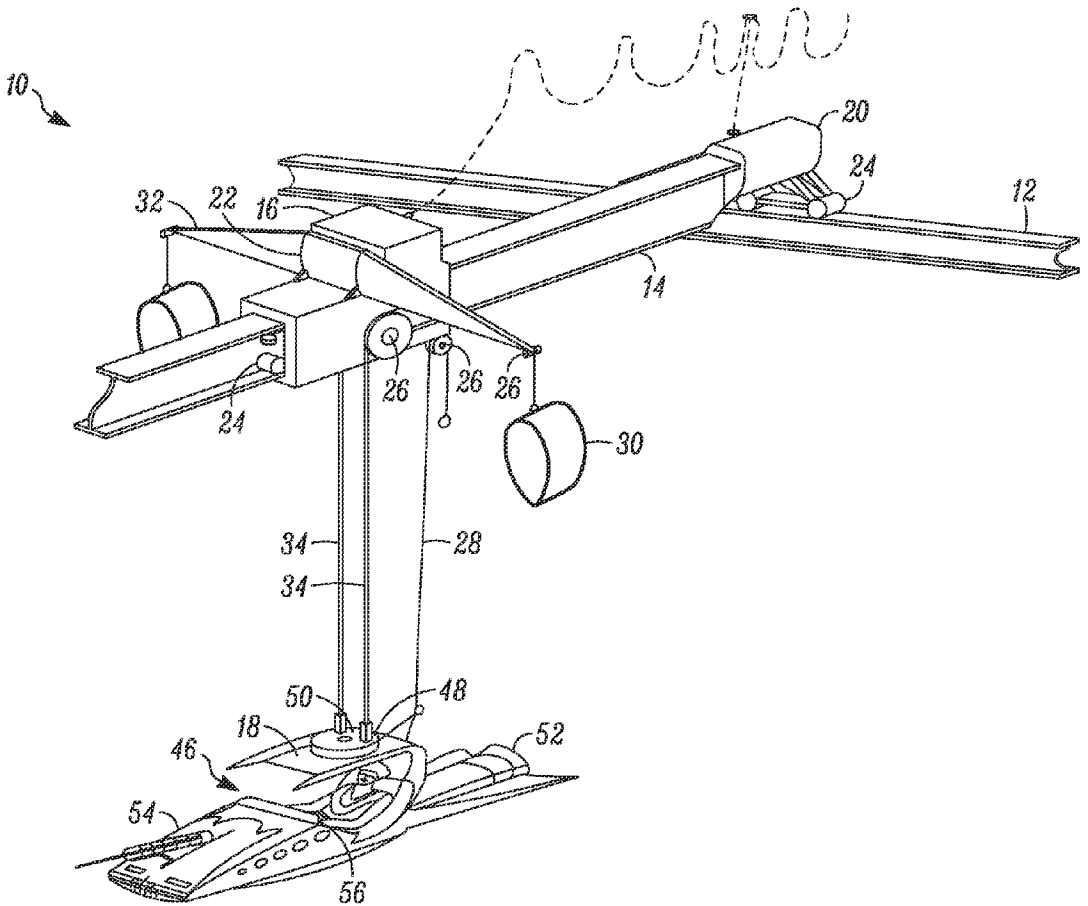
FIG. 1 is a perspective view of a portion of an embodiment of a motion apparatus.

FIG. 1 is a perspective view of a portion of an embodiment of a motion apparatus. In this embodiment, the motion apparatus 10 includes a fixed, primary anchoring element 12, a beam 14, a vessel mount 16, and a vessel 18. The vessel may carry a passenger in one embodiment, but may carry a robot, a camera, cargo, special-purpose machinery, or nothing at all. We refer to this vessel as a passenger vessel in the preferred embodiment without excluding those other possibilities. As described in more detail below, the various components 14-18 move independently relative to each other: the beam 14 can move relative to the primary anchoring element 12, the vessel mount 16 can move along the beam, and the vessel 18 can move vertically relative to the vessel mount 16. These movements may occur simultaneously or individually. Thus, the composite motion of the various components 14-18 allows the vessel 18 to travel to any point in 3D (three dimensional) space within the accessible volume of the motion apparatus 10. Moreover, the vessel's angular orientation can be controlled, as explained more fully below. Thus, the motion apparatus 10 can be used for a variety of training, amusement, repair, construction, or other purposes. For example, one purpose of the motion apparatus 10 is to serve as a flight simulator.

The primary anchoring element is fixed. In some implementations, the primary anchoring element 12 is fixed relative to a floor, ceiling, beam, or other structural element. The primary anchoring element 12 serves as a frame on which the other components 14-18 are mounted. In some embodiments, the primary anchoring element 12 includes one or more tracks 13 along which the beam 14 can translate. In some embodiments, the primary anchoring element 12 includes a post about which the beam 14 can rotate (see FIG. 7, et seq.).

The primary anchoring element 12 can be constructed from any material or materials sufficient to support the components 14-18 during use. The primary anchoring element 12 could for example be constructed from conventional construction products; e.g., concrete, metal, wood fiber reinforced plastics, structural glass, etc. The primary anchoring element 12 could be cast in place, extruded, pulltruded, spincast, etc. The primary anchoring element 12 can be constructed as one continuous component or include several modular components. Desired structural and mechanical requirements (e.g., durability, lightness, etc.) as well as cost, appearance, and other practical constraints are taken into consideration in determining the actual material, form and manufacturing process for the primary anchoring element 12.

In some implementations, the primary anchoring element 12 is constructed to minimize friction between the anchoring element 12 and other components. For example, the primary anchoring element 12 can include a low-friction coating such as Teflon, polytetrafluoroethylene ("PTFE"), ethylene tetrafluoroethylene ("ETFE"), or the like. Additionally or alternatively, the primary anchoring element 12 can include components to reduce friction, such as air bearings or other low-friction bearings, rollers, ball bearings (in a fixed array or in an open tray), electromagnetic levitation circuitry, etc.

Depending on the geometry of the primary anchoring element 12, support members (not shown) may be deployed at one or more points along the primary anchoring element 12 to help maintain its position and help support the components 14-18.

In some implementations, the beam 14 is connected to the primary anchoring element 12 via a beam mount 20. The beam mount 20 is operable to translate along the primary anchoring element 12 and/or rotate relative to the primary anchoring element.

The beam mount 20 can include a motor 24 to drive such motion. The motor 24 can include an electromagnetic motor, a hydraulic motor, a compressed air motor, or any other controllable means operable to move the beam 12. Additionally or alternatively, the beam mount 20 can be moved along the primary anchoring element 12 via a gear and pulley system, continuous cable, chain loop system, or the like driven by a motor remote from the beam mount. Similarly, a system of electromagnets along the beam mount and/or the primary anchoring element 12 can also be employed to drive the beam mount along the primary anchoring element. Power can be supplied without a motor, for example, by a pedaling mechanism operated by a passenger or spectator.

In some implementations, the beam mount 20 includes components such as rollers, pulleys, sprockets, wheels, bearings, guides, or the like to help maintain a proper engagement and minimize friction between the beam mount 20 and the primary anchoring element 12. In some implementations, the beam mount 20 includes gears in place of rollers that mate with suitably dimensioned teeth on the primary anchoring element 12.

The gears, pulleys, sprockets, rollers, wheels, guides, bearings, or similar structures may be included in an assembly that is rotatable with respect to the beam mount 20. This, together with an extensible beam as described below, permits the beam 14 to be mounted on a pair of non-parallel tracks. (See FIG. 7). Gears for our purposes are wheels with teeth intermeshing with other gears. Sprockets are also wheels with teeth that do not intermesh with other wheels but rather with elements like chains. Pulleys have no teeth.

In some implementations, the beam 14 has an "I-beam" geometry. That is, the beam's cross-section has the shape of the capital letter I. In some implementations, the beam has a cylindrical geometry. In some implementations, the beam 14 is extensible. This can be accomplished, for example, by constructing the beam 14 out of two or more telescopically nested components that may be expanded or retracted as desired. In some implementations, an extensible beam may also include a motor, spring, pulley system, hydraulic system, or other means for expanding or retracting the beam.

The vessel mount 16 is movably connected to the beam 14. The vessel mount 16 is operable to translate and/or rotate along the beam 14, and in this sense is similar in purpose (though not necessarily similar in construction) to the beam mount 20. The vessel mount 16 can include a motor to drive translation and/or rotation along the beam, as well as wheels, rollers, bearings, gears, guides, or the like to help maintain a proper engagement and reduce friction between the vessel mount 16 and the beam 14.

Figure 2:
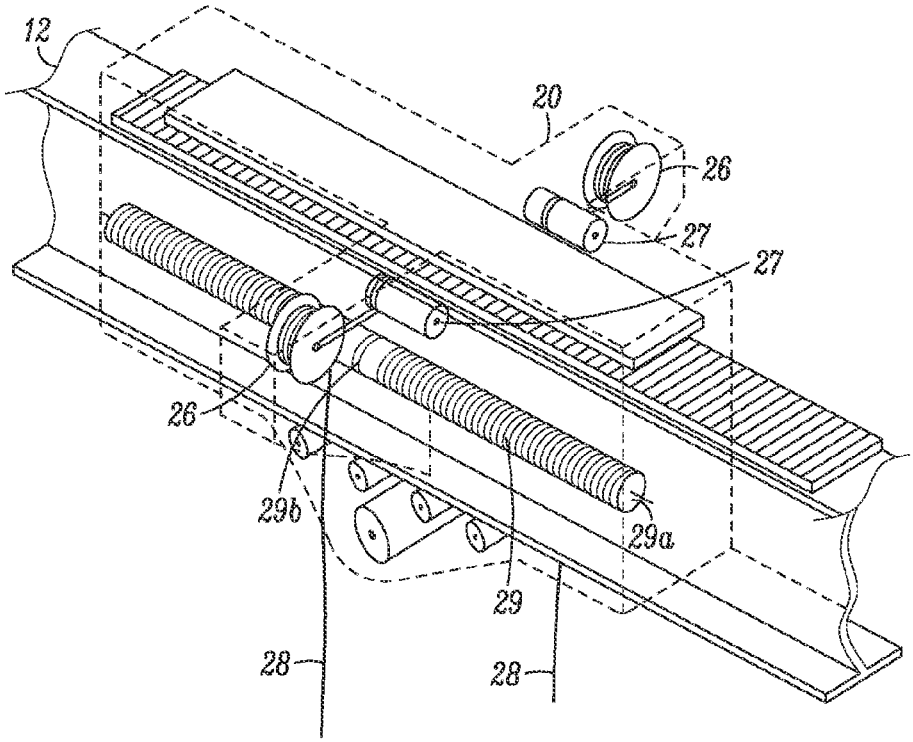
FIG. 2 is a cutaway view of the vessel mount.
Figure 3:
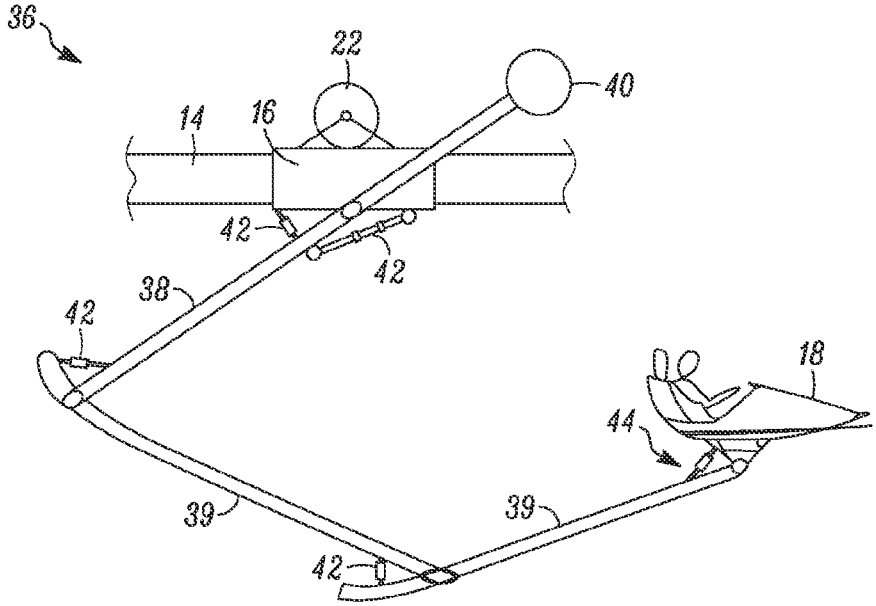
FIG. 3 is a perspective view of a vessel mount including a hydraulic piston.
Figure 10:
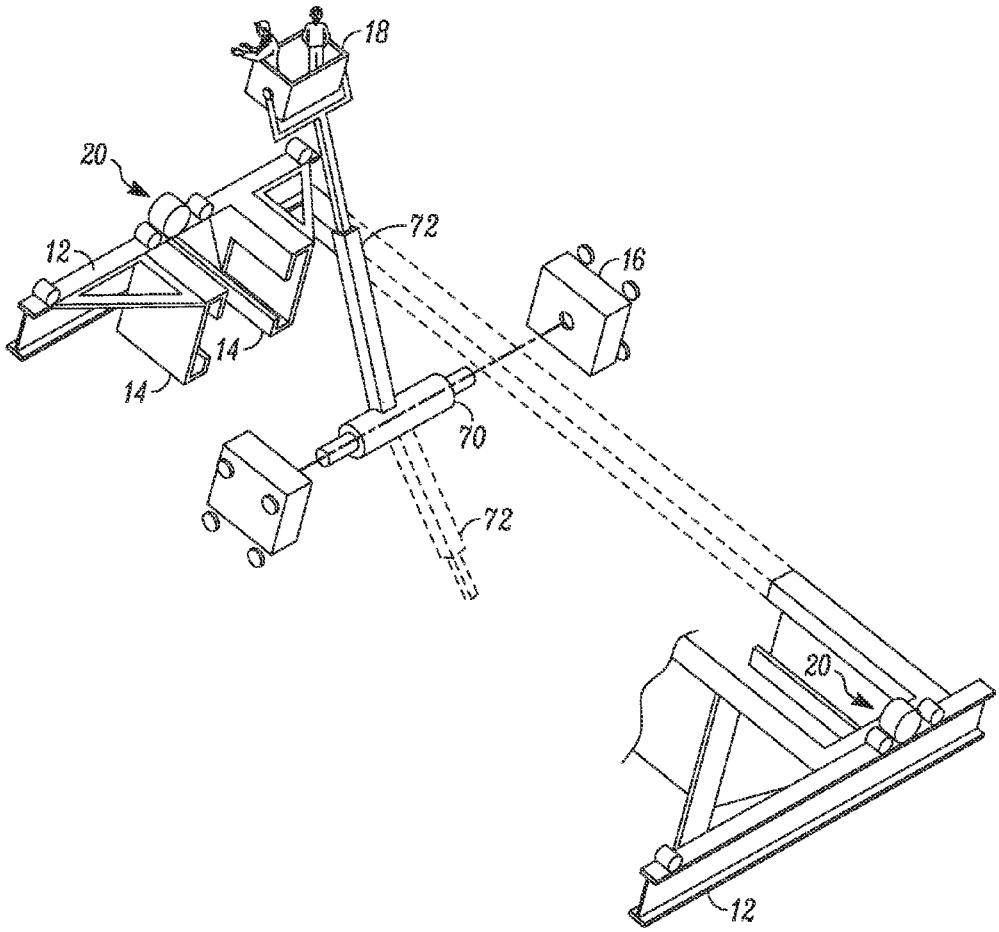
FIG. 10 is an exploded view of another embodiment of a vessel mount.

The vessel mount 16 includes components to move the vessel 18 relative to the beam 14. Among the available alternatives, these components can include a pulley system or a hydraulic system. FIGS. 1 and 2 show a pulley system. FIG. 3 shows a hydraulic system. An alternate configuration for moving the vessel 18 relative to the beam 16 is shown in FIG. 10.

FIG. 2 is a cutaway view of the vessel mount 16. The vessel mount 16 includes one or more pulleys 26 that are each engaged with a corresponding cable 28. One end of each cable 28 is attached to the vessel 18. Each pulley 26 can be driven by a motor 27 operable to turn the gear, thereby raising or lowering the vessel 18.

Additionally or alternatively, the load due to the vessel 18 may be at least partially offset by a torsion element 29. The torsion element 29 includes springs, each of which having a fixed end 29*a* and a freely-rotating end 29*b*. Each cable 28 is mechanically coupled to a freely-rotating end 29*b*, such that lowering the vessel 18 causes the spring to twist, thereby storing potential energy. Thus, the spring's tendency to untwist provides a biasing force that tends to reduce the net force required to move the vessel 18 vertically.

Using a torsion element may be advantageous, for at least the reason that it reduces the load on the motors 27 to move the vessel 18. Thus, in some implementations, the springs of the torsion element 29 are chosen to minimize the average load on the motors 27. That is, in some implementations, the springs of the torsion element 29 are constructed to offset an expected average weight of the vessel 18.

In some implementations, one end of each cable 28 is attached to its corresponding pulley 26. Thus, the pulley 26 operates as a drum, which spools or unspools the cable during vertical movement of the vessel 18.

Referring back to FIG. 1, in addition to or instead of a torsion element 29, in some implementations, one end of the cable 28 is attached to a counterweight 30. When the counterweight's mass is equal to the mass of the vessel 18 plus its contents, then minimal energy is required to raise and lower the vessel. Thus, the counterweight's mass can be chosen to approximate the mass of the vessel 18 plus the anticipated load due to the contents of the vessel, including but not limited to one or more passengers.

The motion apparatus 10 can optionally include circuitry to monitor the difference in these masses, which can be useful for choosing an optimal counterweight, torsion element 29, or both. For example, the circuitry can be configured to alert an operator of the motion apparatus 10 if, on average, this difference is greater than a specified threshold over a specified time period.

If a counterweight 30 is used, then the vessel mount 16 is constructed such that raising and lowering the vessel 18 using the counterweight 30 does not present a risk of collision between the vessel and the counterweight. For example, vessel mount 16 may include a support arm 32 on which the counterweight 30 is mounted, ensuring a safe displacement from the vessel 18. Additionally or alternatively, one or both of the vessel 18 or counterweight 30 may be stabilized by a rigid guide to help prevent sway in the vessel and/or the counterweight. In some implementations, the rigid guide 34 may be a single component (e.g., a metal or plastic tube) that mates with a suitably-dimensioned hole on the counterweight 30 or vessel 18. In some implementations, the rigid guide 34 may include several nested components that telescopically expand or contract according to the motion of the vessel 18 or the counterweight 30.

Any number of cables 28, torsion elements 29, and/or counterweights 30 can be used. Each cable 28 can be mounted to different structures and/or locations on the vessel 18, and each cable 28 can be individually actuated. By actuating each cable 28 a different amount, the orientation of the vessel 18 can be changed. For example, using four cables 28, the pitch and/or roll of the vessel can be controlled by differentially actuating opposing pairs of cables.

FIG. 3 is a perspective view of a hydraulic system 36. The hydraulic system 36 is operable to move the vessel in a plane perpendicular to the beam 14. Rotation in this plane can inherently include vertical movement of the vessel 18 with respect to the beam 14. The hydraulic system includes a boom 38 rotatably connected to the beam 14 via a vessel mount 16.

The hydraulic system 36 may include at least one additional arm 39 pivotably connected in serial to the boom 38 or to each other. The boom 38 and/or each arm 39 may be a rigid structure, or alternatively may include one or more nested structures configured to telescopically expand or retract.

The vessel 18 is mounted on one end of the boom 38 (or arm 39, if any), and a counterbalance 40 is mounted on the other end of the boom 38. The mass and position of the counterbalance 40 is chosen so that the center of mass of the vessel/boom/counterbalance system is collinear with the axis of rotation of the boom 38, thereby minimizing the energy required to pivot the system. The counterbalance 40 may be an "active" counterbalance; i.e., a counterbalance with a controllable position. Thus, the position of the active counterbalance 40 can be adjusted to dynamically control the center of mass (i.e., maintain its position at the pivot point). For example, the position of the counterbalance 40 may be controlled by telescopically expanding or contracting the portion of the boom 38 on which the counterweight is mounted. Other control mechanisms are possible.

The boom 38 is actuated by one or more hydraulic pistons 42 mounted to the boom 38 and the vessel mount 16. The expansion or contraction of the piston(s) 42 causes the boom to rotate about its pivot point accordingly. Similarly, one or more hydraulic pistons 42 mounted between the boom 38 and an arm 39 (or mounted between one arm and another) cause the arm(s) to pivot according to the expansion or contraction of the pistons.

The vessel 18 is mounted to the terminal arm 39 via a platform 44. The platform 44 may have additional hydraulics to control the orientation (i.e., yaw, pitch, and/or roll) of the vessel 18.

Figure 4:
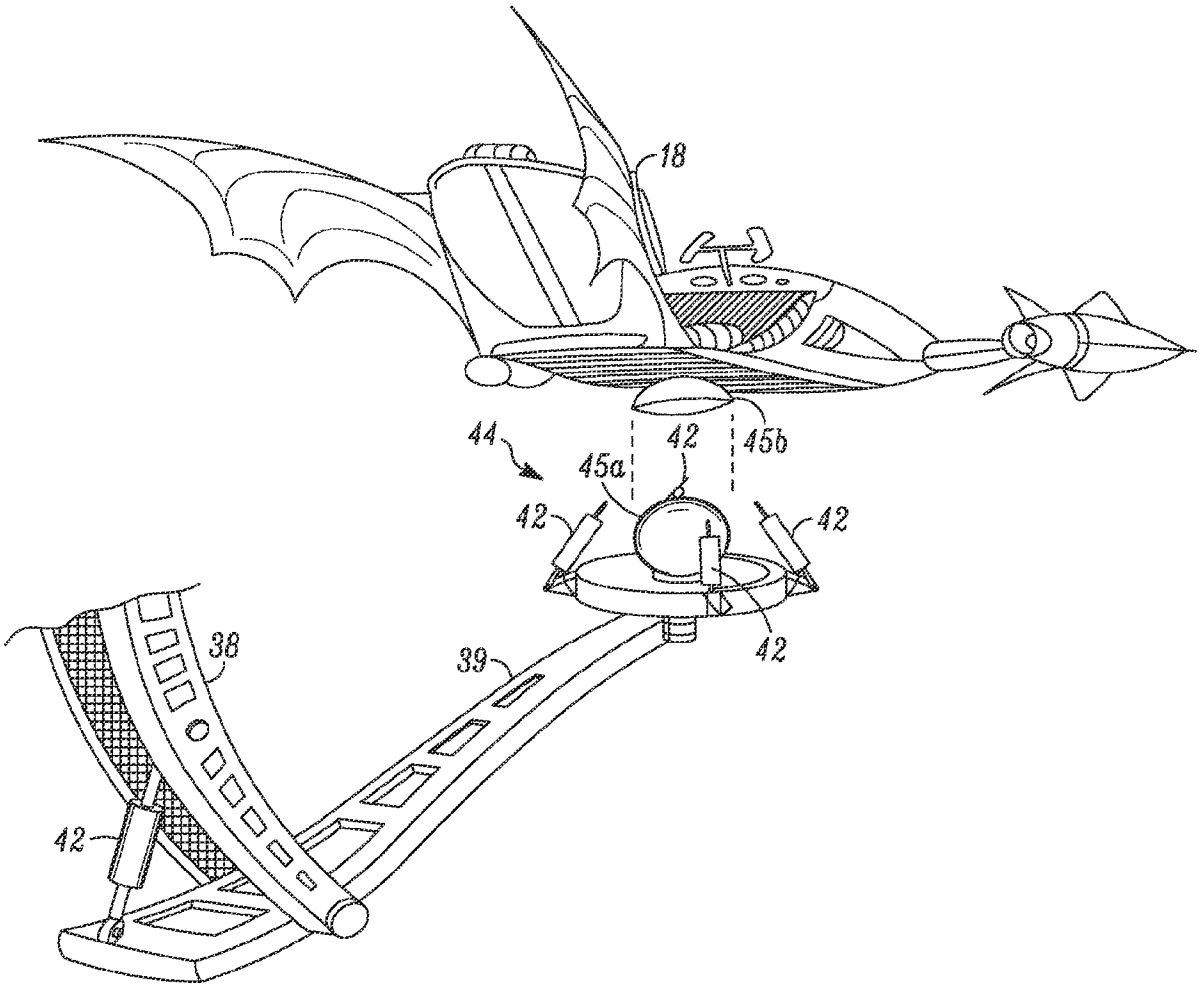
FIG. 4 is a perspective view of a hydraulic platform for a vessel.

FIG. 4 is a perspective view of a platform on which the vessel is mounted. The platform 44 includes hydraulic pistons 42 that mechanically couple the vessel 18 with the platform. By individually actuating the various hydraulic pistons 42, the orientation of the vessel 18 with respect to the platform 44 can be controlled.

In some implementations, the platform 44 also includes a structural support 45*a* that mates with a mounting element 45*b* on the vessel 18. The mounting element 45*b* is suitably dimensioned to receive the structural support 45*a* and still provide any desired degrees of freedom of motion.

For example, in FIG. 4, the structural support 45*a* and the mounting element 45*b* are spherical. Thus, the vessel 18 can yaw, pitch, or roll around the structural support 45*a*. In another example, the structural support 45*a* can be cylindrical, thereby providing the vessel 18 only one degree of rotational freedom about the cylinder's axis.

Although the structural support 45*a* is not strictly necessary, using such a support helps bear the load of the vessel 18. Consequently, using such a support reduces the energy necessary for the hydraulic pistons 42 to move the vessel 18.

In all the foregoing, any component requiring an energy source (e.g., motors, control units, etc.) can be supplied by any known source or combination of sources, including batteries or other energy storage devices, electrical energy transmitted from a power line, wirelessly, supplied from a solar cell, etc., mechanical energy supplied by humans (e.g., passengers in the vessel 18), etc. In some implementations, components of the motion apparatus 10 are equipped with solar cells for energy collection. In some implementations, the vessel 18 includes hardware to collect human-supplied energy. For example, such hardware can include pedals, pulleys, cables, or other equipment coupled to a generator or other device for converting mechanical energy to electrical energy. In some cases, it may not be necessary to use electrical energy at all, as pure mechanical coupling is possible.

In all the foregoing, any of the components that move (e.g., the vessel mount 16, the vessel 18, the beam mount 20, etc.) can include a braking system operable to convert the kinetic energy of the component's motion to mechanical, potential, or electrical energy. In some implementations, this recaptured energy is stored in a flywheel or other energy storage device remote from the motion apparatus 10. Energy recaptured in this way can be used to power the motion apparatus 10 or for other purposes.

Such braking include passenger-controlled braking during "flight," or automated braking. For example, on a track that runs down hill, a freely-moving beam mount 20 would traverse the track downhill with constant nonzero acceleration. However, the beam mount 20 may be controlled via automatic braking to maintain a constant speed with zero acceleration, with the excess energy being captured and stored remotely.

Referring back to FIG. 1, the vessel 18 may include a passenger compartment 46, a yaw plate 48, a motor 50, a counterweight 52, a simulated weapon 54, and a control unit 56.

The passenger compartment 46 is dimensioned to accommodate one or more passengers. It includes conventional components of such compartments to provide for the comfort and safety of the passengers therein. Such conventional components include one or more seats, platforms, safety restraints, airbags, etc. The passenger compartment 46 can accommodate passengers in any configuration—sitting, standing, lying down, etc.

The yaw plate 48 is rotatably mounted to the vessel 18 via one or more shafts (not shown). The yaw plate 48 is operable to allow the orientation of the vessel 18 to change in a plane parallel to the ground. The motor 40 is operable to provide the required torque to induce this change. The motor 40 can be any motor sufficient to deliver the required torque; e.g., an electric motor, hydraulic motor, etc. In some implementations, the cables 28 and/or rigid support 34 are mounted to the yaw plate 48, such that the yaw plate remains fixed relative to the cables and/or rigid support while the vessel 18 rotates relative to the yaw plate. In some implementations, the yaw plate 48 is integrated into the platform 44 rather than the vessel 18. In some implementations, the yaw plate 48 is omitted, and yaw control is performed either hydraulically using the pistons on the platform 44, using propellers or ducted fans, mounted to the vessel 18, or using inertial techniques, such as shifting a weight (e.g., the passenger's weight) from side to side, using one or more gyroscopes to stabilize or control the vessel's rotation about one or more axes, etc.

The energy required to rotate the vessel 18 relative to the yaw plate 48 is minimized when the center of mass of the vessel is collinear with the axis of rotation. The mass and position of the counterweight 52 can be selected based on the geometry and construction of the other components of the vessel 18 (along with the anticipated load due to passenger(s)) to move the center of mass of the vessel 18 to coincide (or approximately coincide) with this axis of rotation.

The simulated weapon 54 may include an electromagnetic radiation source such as a laser, LED, or other source. The radiation source generates a beam of electromagnetic energy (e.g., infrared radiation) that encodes an identity of the vessel 18 from which it originated. The electromagnetic radiation source may also fire an energy beam in the visible spectrum to enhance the realism of the experience, assist in aiming, or other reasons. Alternatively or additionally, the simulated weapon 54 may include a projectile launcher. Such projectiles are chosen to afford a desired level of safety. Relatively safe projectiles include missiles or bullets constructed from foam, rubber, or the like.

The vessel 18 may also include one or more sensors to detect successful hits from a simulated weapon 54. For example, the sensors may include pressure sensors, or sensors of electromagnetic radiation. Sensors of electromagnetic radiation can be configured to identify a source of the vessel 18 from which the detected beam originated. This allows a score to be associated with a vessel 18 in a multi-player environment.

In response to a detected "hit," the vessel 18 can take a specified action. Such a specified action can simulate an actual hit; e.g., release a smoke flash, sound an alarm in the passenger compartment 46, cause a jarring motion of the vessel, reduce the maneuverability or top speed of the vessel, etc. Additionally or alternatively, software in the motion apparatus 10 can adjust the score of the pilot of the firing and/or hit vessel 18, or adjust other electronically-stored characteristics of the vessel, such as a number of lives, a number of remaining armor points, a number of remaining hit points, etc.

The control unit 56 is operable to control the trajectory and operation of the vessel 18. This is accomplished by controlling the various movable components of the motion apparatus 10 itself (e.g., the beam mount 20, the vessel mount 18, etc.) In some implementations, the control unit 56 includes a joystick, throttle, foot pedals, or other such components as would be found in a conventional flight simulator. The control unit 56 may include other controls pertinent to simulated gameplay, such as controls to fire weapons, to deploy simulated flares, to raise shields, etc. The control unit 56 can be configured to simulate airplane controls, helicopter controls, hovercraft controls, or other configurations.

The control unit 56 may be implemented as hardware, software, or a combination of hardware and software. For example, each control unit 56 can include a computer processor or other circuitry configured to receive input from the various components of the control unit (joystick, throttle, etc.) and convert the input to an electronic control signal that is sent to the various components of the motion apparatus (beam mount, vessel mount, etc.) to cause the appropriate corresponding motion.

In some implementations, the control signal is limited to applicable constraints. For example, as discussed in more detail below, in some implementations the motion apparatus 10 includes anti-collision routines for the safety of the passengers. Such anti-collision routines may limit the trajectories of particular vessels 18 that are otherwise available. Other external limitations may be provided; e.g., automatically returning a vessel to a pre-determined point after an elapsed time duration; automatically controlling one or more motion aspects (such as speed along a track) while allowing passengers to control other aspects (such as altitude, yaw, pitch, and roll).

In some implementations, the control unit 56 may include controls for more than one person. For example, one set of controls can be directed to "driving" or "flying" the passenger unit 18, while another set of controls can be directed to simulated combat tasks such as targeting and firing.

Although only one anchoring element 12 is shown in FIG. 1, two anchoring elements can also accommodate a single beam 14. Each end of the beam 14 is mounted to each anchoring element 12 using a separate beam mount 20. The anchoring element(s) 12 can be arranged in any geometry. In some implementations, one or more anchoring elements are arranged to form a track.

Figure 5A:
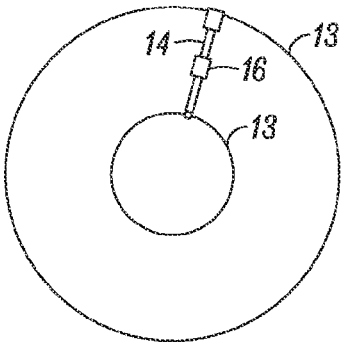
FIGS. 5A-F show various track configurations.
Figure 5C:
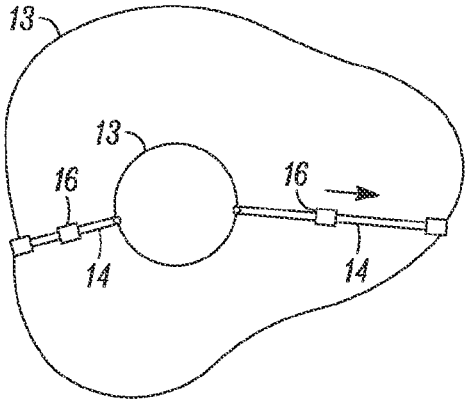
Figure 5B:
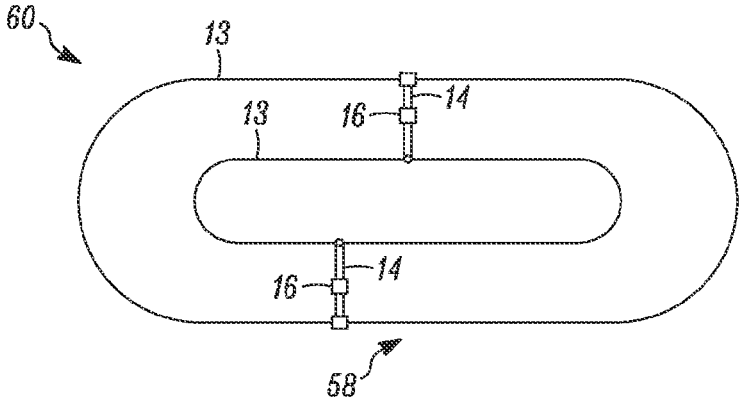

For example, FIGS. 5A-F show various configurations. In FIG. 5A, two concentric circular tracks 13 are configured to form an annulus. In FIG. 5B, two tracks 13 are arranged in a "race track" configuration that includes straightaway sections 58 and turns 60. In FIG. 5C, two nested tracks 13 arranged in an irregular closed loop configuration.

Figure 5D:
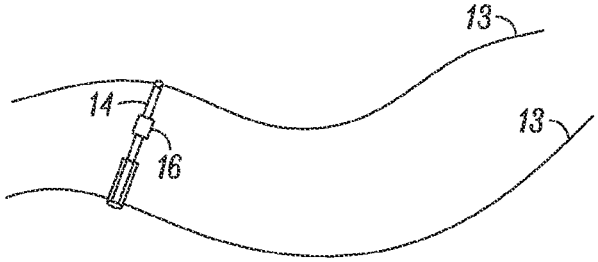
Figure 5E:
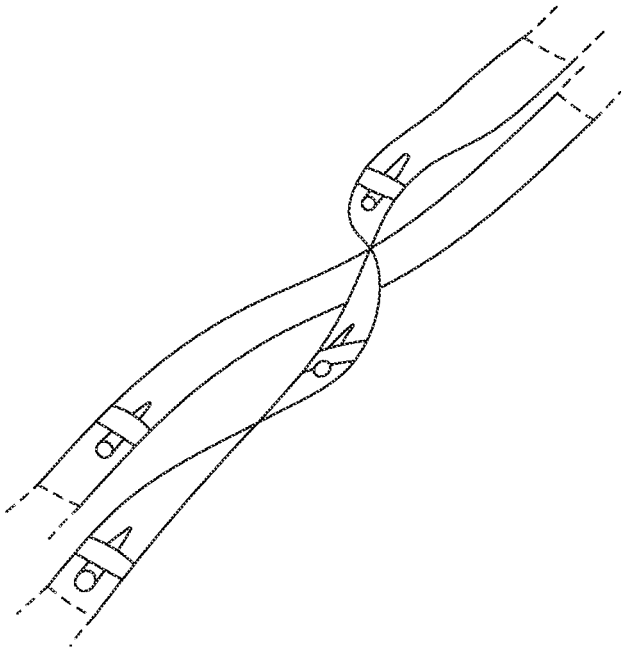
Figure 5F:
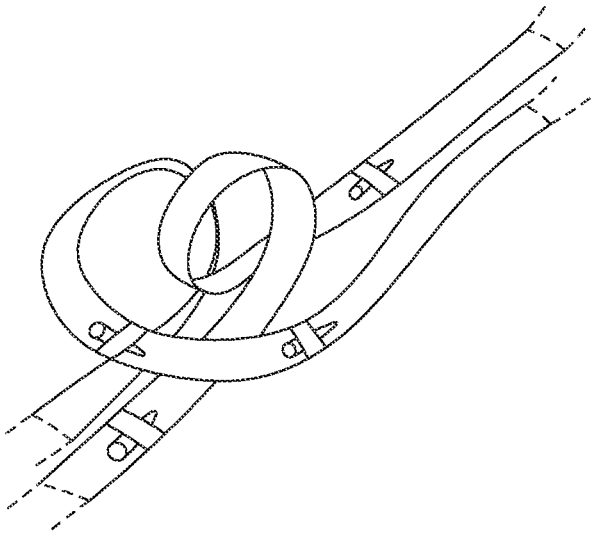

As used herein, "irregular" refers to the possibility that the tracks 13 are not separated by a constant distance. For irregular track configurations, the beam 14 is extensible. For irregular configurations, the tracks are approximately parallel. The phrase "approximately" denotes that the variation in inter-track distance is no greater than the degree to which the beam 14 is extensible. In particular, the phrase "approximately parallel" encompasses the case the tracks are actually parallel (i.e., where the tracks have no variation in inter-track distance.) In FIG. 5D, the tracks are arranged in an irregular, non-closed configuration.

Moreover, the tracks 13 need not lie in a plane. For example, one or more tracks 13 could twist, loop, or ascend, descend, etc. In some implementations, the tracks 13 can twist relative to each other (FIG. 5E), one track can pass through a loop formed by another track (FIG. 5E), etc. Such configurations can be used, e.g., to simulate a "dogfight" scenario. Many other configurations in which a beam is connected to two or even more anchors besides those shown in FIGS. 5A-F are possible.

A beam 14 may move in either direction along a track 13. Thus, in an amusement ride context with more than one track, different passengers may travel in the same direction—as in a race scenario—or may travel in opposite directions—as in a "chicken" scenario.

Tracks arranged in a closed loop have the characteristic that passengers may exit the motion apparatus at the same point at which they boarded. This can be convenient, e.g., in an amusement park setting in which a rider (e.g., a child) may join a non-rider (e.g., a parent) after using the motion apparatus. Tracks arranged in a non-closed configuration have the characteristic that passengers may exit the motion apparatus at a point different from where they entered. This can be convenient to provide an entertaining way for patrons to travel from one part of an establishment to another. Additionally, having two or more distinct entry points allows passengers to wait in more than one line, thus helping to keep the length of a particular line low.

Figure 6:
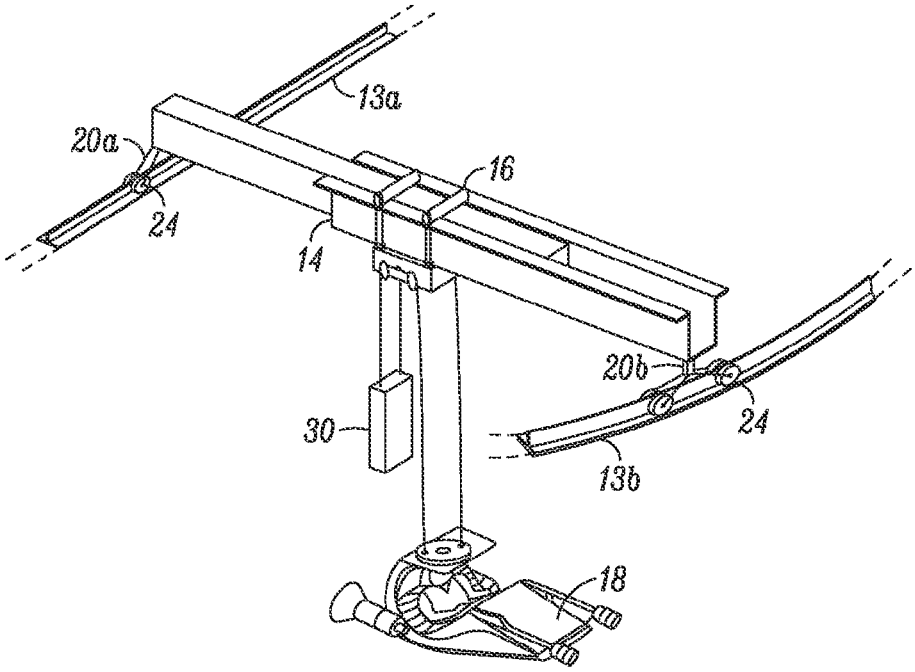
FIG. 6 is a perspective view of an irregular track configuration involving a straight track and a curved track.

FIG. 6 is a perspective view of an irregular track configuration involving a straight track 13*a* and a curved track 13*b*. Each end of the beam 14 is mounted to each track via corresponding beam mounts 20*a*, 20*b*. In beam mount 20*b*, as described above, the rollers of the beam mount 20*b* are rotatably installed on the beam mount 20*b*, being free to rotate at rotation point 21. This, together, with the extensibility of the beam 14, allows the beam mount 20*b* to traverse the curved track 13*b*.

The motion apparatus 10 can also include obstacles, water hazards, or the like. Such objects may be used to enhance the enjoyment of passengers in an amusement park setting. The obstacles are constructed to maintain the safety of the passenger and the structural integrity of the motion apparatus 10 in the event of a collision. For example, the obstacles may include inflatable balloons; light or soft plastic, foam, etc.

In some implementations, the obstacles include sensors to determine when an obstacle has been hit. For example, obstacles can be mounted on pressure sensors or proximity sensors operable to determine whether the obstacle is displaced. In turn, detecting when an obstacle has been hit can be used to define various games that can be played with the motion apparatus. For example, a slalom (or more generally, an obstacle course) race can be played, with the object of flying from one location to another while knocking down a minimum number (or maximum number) of obstacles. In another example, a "bowling" game can be played, with the goal of knocking down a maximum number of obstacles in a single pass.

Figure 7:
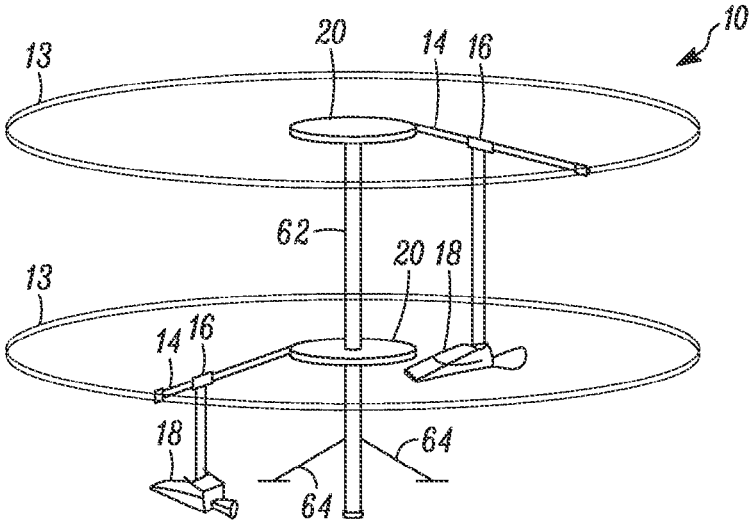
FIGS. 7 and 8 show alternative configurations for the primary anchoring element.

FIG. 7 shows an alternative configuration for the motion apparatus 10. In FIG. 7, the primary anchoring element is configured as a post 62. The post 62 can accommodate one or more beams 14, each of which is mounted to the post 62 via a beam mount 20. The post can be constructed with any geometry. In some implementations, the post 62 is cylindrical or substantially cylindrical. Depending on the dimensions and materials of the post 62, one or more support structures 64 can be used to provide stability for the post 62. Similarly, depending on the beam 14, one or more support structures 66 can be used to provide stability for the beam.

The one or more beams are mounted to the post 62 via beam mounts 20. The beam mounts 20 can be rotatably installed directly on the post 62. Alternatively, the post 62 can be equipped with a track or guide along its circumference to assist the engagement between the post 62 and any beam mount 20. In some implementations, a beam mount 20 is also vertically movable along the post 62. This type of motion, in conjunction with the vertical motion afforded by the vessel mount 16, can be combined in moving the vessel 18 vertically. Alternatively, in some implementations, the post 62 itself can rotate relative to the ground, where the beam mount 20 remains fixed with respect to the post.

Figure 8:
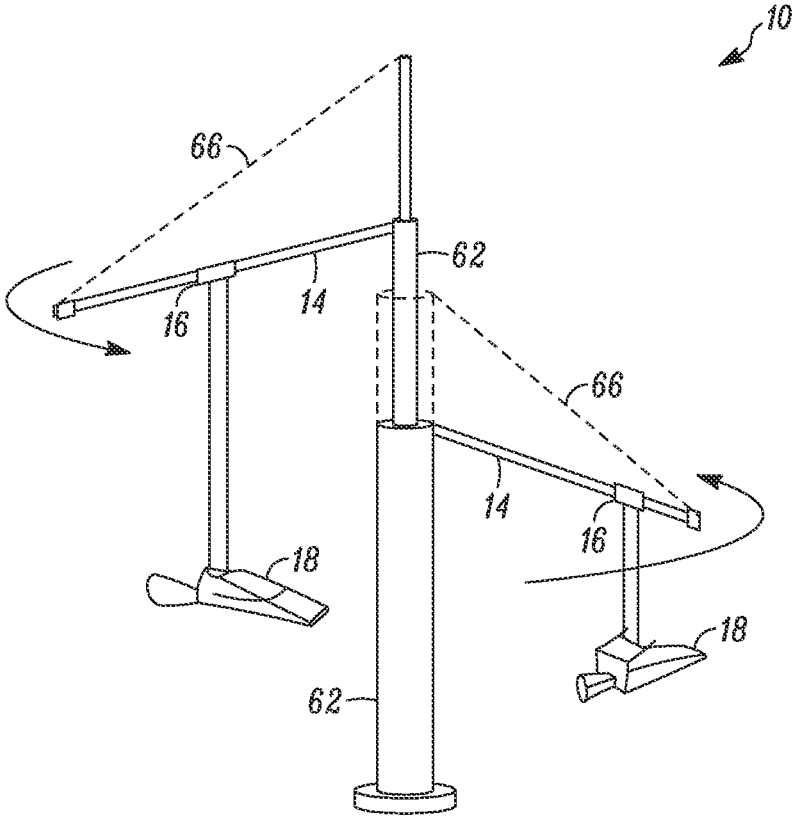

Referring to FIG. 8, multiple posts 62 can nested within each other, with each post bearing one or more beams 14, vessels 18, etc. Each vessel 18 can navigate within a corresponding accessible volume. In some implementations, the accessible volumes are disjoint. For example, each vessel 18 may be given its own height range that other vessels cannot access. This may be accomplished, for example, by arranging that the multiple nested posts 62 have different heights. For example, the heights of the posts 62 can increase as their radius decreases, with the vessel occupying the highest height range being mounted to the inner-most post, the vessel occupying the second highest height range being mounted to the second inner-most post, etc. Similarly, each vessel may be given its own angular "slice" of the total accessible volume of all vessels. Other arrangements are possible to partition the total accessible volume amongst the vessels.

In some implementations, the (collective) accessible volume of the vessels 18 is not partitioned. This allows multiple vessels 18 to navigate in the same (or substantially the same) volume. For example, in some implementations, the vessels 18 can be further outfitted with safety equipment in a three dimensional "bumper cars" scenario. In this case, the top speed of the vessels 18 is controlled to help assure that collisions are at a safe speed. In some implementations, the motion apparatus 10 can include anti-collision circuitry for passenger safety. Such circuitry may include a control system to dynamically limit the available positions and/or velocities of the various vessels to prevent crashes or unsafe accelerations.

Figure 9:
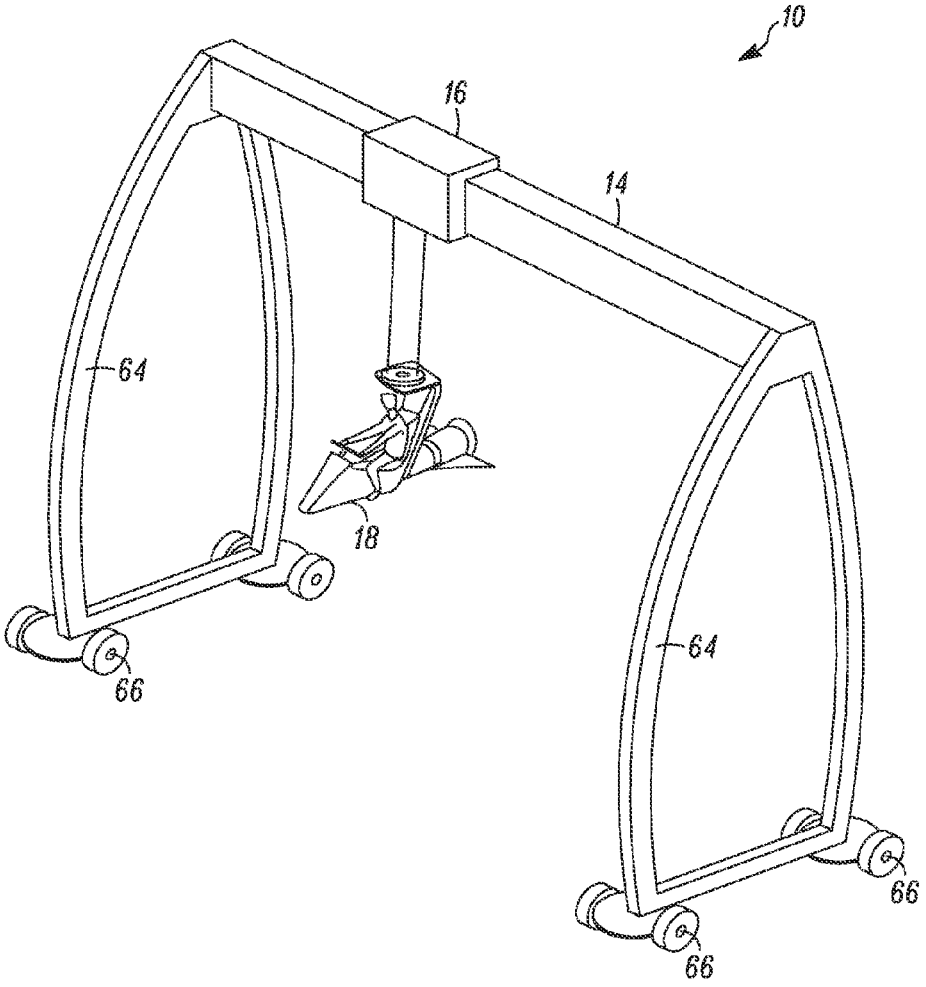
FIG. 9 is a perspective view of another embodiment of the motion apparatus.

Referring to FIG. 9, another embodiment of the motion apparatus 10 is shown. The motion apparatus 10 includes a beam 14 fixedly mounted to a pair of supports 64. The beam 14 bears a vessel mount 16 and a vessel 18, as those components are described above.

Each support 64 is mounted on a steerable set of wheels 66, which are responsive to the control unit 56. The wheels 66 are driven by a motor (not shown). The motor can include any known source of mechanical energy capable of propelling the motion apparatus 10; e.g., an internal combustion motor, electric motor, etc. Additionally or alternatively, the motion apparatus 10 can be human-powered.

FIG. 10 is an exploded view of an alternative vessel mount. Rather than components for moving the vessel 18 vertically relative to the beam 14, the vessel mount 16 includes an axle 70 and one or more vessel booms 72 rotatably mounted on the axle. In some implementations, the vessel boom 72 is telescoping, thereby allowing the vessel 18 to move with two degrees of freedom (radial and rotational) with respect to the vessel mount 16.

In some implementations, the control unit 56 includes controls for radial and rotational motion. Additionally or alternatively, the control unit 56 may include controls for rectilinear motion, e.g., in a plane defined by the vessel boom 72 and the beam 14. In some implementations, radial and rotational control signals are produced from rectilinear control input using polar coordinate transformations.

In some implementations, the control signals are constrained to prevent the vessel from colliding with the beam 14 or other structure within the otherwise-accessible volume of the motion apparatus 10. In some implementations, the beam 14 is suitably dimensioned so as to allow the vessel 18 to pass through it, thereby allowing full three hundred and sixty degree rotation of the vessel boom 72 about the axle 70.

In some implementations, the vessel 18 is self-leveling; i.e., maintains a constant orientation with respect to the ground. The self-leveling may be implemented in several ways. In some implementations, the vessel 18 freely rotates on an axis (not shown), such that its natural resting position is horizontal. In some implementations, the vessel 18 rotates on an axis in a controlled fashion (e.g., through the use of motors, pistons, etc.), with an orientation-maintaining control signal providing the self-leveling functionality. Other ways to self-level are possible.

In some implementations, the vessel boom 72 can include a counterweight (not shown). Rotating the vessel boom 72 about the axle 70 requires relatively little energy when the center of mass of the vessel boom is located within the axle. Thus, the counterweight is selected and positioned so as to accomplish this. In some implementations, the counterweight is mounted on a projection of the vessel boom 72 that extends radially in the direction opposite that of the vessel 18. In some implementations, the position of the counterweight can be radially controlled, e.g. to match the radial position of the vessel 18.

While the invention has been disclosed in connection with certain embodiments, other embodiments are possible and will be recognized by those of ordinary skill in the art. All such variations, modifications, and substitutions are intended to fall within the scope of this disclosure. Thus, the invention is to be understood with reference to the following claims.

What is claimed is:

1. An apparatus comprising:
- a fixed primary anchoring element;
- a beam mount movably connected to the primary anchoring element;
- a beam connected to the beam mount;
- a vessel mount movably connected to the beam;
- a vessel connected to the vessel mount, the vessel being movable along at least a vertical axis;
- a yaw plate coupled to the vessel operable to change the vessel's yaw; and
- a control unit within the vessel configured to accept control input from a passenger within the vessel and transmit at least one control signal to cause the beam to move relative to the primary anchoring element, the vessel mount to move relative to the beam, and the vessel to move relative to the vessel mount independently.

2. The apparatus of claim 1, in which the primary anchoring element includes a first post, and the beam mount is configured to rotate around the post.

3. The apparatus of claim 1, further comprising a beam connected to the beam mount, in which the beam mount includes a support member.

4. The apparatus of claim 2, further comprising a second nested post within the first post and a second beam mount rotatably connected to the second post.

5. The apparatus of claim 1, wherein the primary anchoring element includes a first track, wherein the beam mount is configured to move along the first track.

6. The apparatus of claim 5, wherein the first track comprises a closed loop.

7. The apparatus of claim 5, further comprising a second track approximately parallel to the first track.

8. The apparatus of claim 5, further comprising a second beam mount movably connected to the first track.

9. The apparatus of claim 8, further comprising a second beam connected to the second beam mount, wherein the second beam is cantilevered with respect to the first track.

10. The apparatus of claim 7, further comprising a third track.

11. The apparatus of claim 1, further comprising an energy recapture system for braking.

12. The apparatus of claim 11, wherein the energy recapture system includes a flywheel.

13. The apparatus of claim 1, further comprising a counterweight configured to at least partially offset the weight of the vessel.

14. The apparatus of claim 1, further comprising a torsion element configured to at least partially offset the weight of the vessel.

15. The apparatus of claim 1, in which the beam is extensible along an axis.

16. The apparatus of claim 1, further comprising obstacles in an accessible volume of the vessel.

17. The apparatus of claim 1, further including a weapon mounted on the vessel.

18. The apparatus of claim 1, further comprising a mechanism to control pitch.

19. The apparatus of claim 1, further comprising a mechanism to control roll.

20. The apparatus of claim 1, further comprising a gyroscope coupled to the vessel.

21. The apparatus of claim 1, wherein the vessel mount includes a hydraulic system operable to move the vessel.

22. The apparatus of claim 21, wherein the hydraulic system includes a counterbalance.

23. The apparatus of claim 21, wherein the hydraulic system includes a first hydraulic arm rotatably connected to the vessel mount, and a second hydraulic arm rotatably connected to the first hydraulic arm, wherein the vessel is mounted to the second hydraulic arm.

24. An apparatus comprising:
- a fixed primary anchoring element;
- a beam mount movably connected to the primary anchoring element;
- a beam connected to the beam mount;
- a vessel mount movably connected to the beam;
- a vessel connected to the vessel mount, the vessel being movable along at least a vertical axis;
- a mechanism to control a pitch of the vessel; and
- a control unit within the vessel configured to accept control input from a passenger within the vessel and transmit at least one control signal to cause the beam to move relative to the primary anchoring element, the vessel mount to move relative to the beam, and the vessel to move relative to the vessel mount independently.

25. An apparatus comprising:
- a fixed primary anchoring element;
- a beam mount movably connected to the primary anchoring element;
- a beam connected to the beam mount;
- a vessel mount movably connected to the beam;
- a vessel connected to the vessel mount, the vessel being movable along at least a vertical axis;
- a mechanism to control a roll of the vessel; and
- a control unit within the vessel configured to accept control input from a passenger within the vessel and transmit at least one control signal to cause the beam to move relative to the primary anchoring element, the vessel mount to move relative to the beam, and the vessel to move relative to the vessel mount independently.

* * * * *